US010864412B2

(12) United States Patent
Stokke et al.

(10) Patent No.: US 10,864,412 B2
(45) **Date of Patent: *Dec. 15, 2020**

(54) GOLF CLUB HEADS WITH SOLE WEIGHTS AND RELATED METHODS

(71) Applicant: KARSTEN MANUFACTURING CORPORATION, Phoenix, AZ (US)

(72) Inventors: Ryan M. Stokke, Anthem, AZ (US); Michael R. Nicolette, Scottsdale, AZ (US)

(73) Assignee: Karsten Manufacturing Corporation, Phoenix, AZ (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/509,389

(22) Filed: Jul. 11, 2019

(65) Prior Publication Data

US 2019/0329103 A1 Oct. 31, 2019

Related U.S. Application Data

(63) Continuation of application No. 15/969,575, filed on May 2, 2018, now Pat. No. 10,369,430, which is a continuation of application No. 15/226,860, filed on Aug. 2, 2016, now Pat. No. 9,987,525, which is a continuation of application No. 13/952,425, filed on Jul. 26, 2013, now Pat. No. 9,415,280.

(51) Int. Cl.

| | |
|---|---|
| ***A63B 53/04*** | (2015.01) |
| ***A63B 53/06*** | (2015.01) |
| ***A63B 60/00*** | (2015.01) |
| ***A63B 60/42*** | (2015.01) |

(52) U.S. Cl.
CPC ..... *A63B 53/0466* (2013.01); *A63B 53/06* (2013.01); *A63B 60/00* (2015.10); *A63B 60/42* (2015.10); *A63B 2053/0412* (2013.01); *A63B 2053/0433* (2013.01); *A63B 2053/0491* (2013.01)

(58) Field of Classification Search
USPC ..... 473/324–350
See application file for complete search history.

(56) References Cited

U.S. PATENT DOCUMENTS

| | | | |
|---|---|---|---|
| 1,213,382 | A | 1/1917 | Kent |
| 1,913,821 | A | 6/1933 | Stumpf |

(Continued)

FOREIGN PATENT DOCUMENTS

| | | |
|---|---|---|
| JP | 2006223788 | 8/2006 |
| JP | 2006320493 | 11/2006 |

(Continued)

*Primary Examiner* — Alvin A Hunter

(57) ABSTRACT

Disclosed herein are some embodiments of a golf club head with a tapered sole weight. One embodiment comprises a golf club head comprising a sole weight; and a body comprising a sole comprising an exterior sole surface, wherein a sole weight port is formed in the sole. The sole weight port can have a port top comprising an interior port top surface and an exterior port top surface, wherein the interior port top surface has a taper of plus or minus approximately 1-89 degrees with respect to the exterior port top surface. The sole weight port can comprise a weight-receiving cavity that engages the sole weight. Other embodiments for related club heads and methods are also disclosed.

20 Claims, 5 Drawing Sheets

(56) References Cited

U.S. PATENT DOCUMENTS

| | | | | |
|---|---|---|---|---|
| 2,257,575 | A | 9/1941 | Reach | |
| 2,328,583 | A | 9/1943 | Reach | |
| 2,360,364 | A | 10/1944 | Reach | |
| 3,064,980 | A | 11/1962 | Steiner | |
| 5,873,791 | A | 2/1999 | Allen | |
| 5,916,042 | A | 6/1999 | Reimers | |
| 5,954,596 | A * | 9/1999 | Noble | A63B 53/02 473/346 |
| 6,533,679 | B1 | 3/2003 | McCabe et al. | |
| 6,719,641 | B2 | 4/2004 | Dabbs et al. | |
| 6,773,360 | B2 | 8/2004 | Willett | |
| 6,875,130 | B2 | 4/2005 | Nishio | |
| 6,991,558 | B2 | 1/2006 | Beach et al. | |
| 7,083,530 | B2 | 8/2006 | Wahl et al. | |
| 7,153,220 | B2 | 12/2006 | Lo | |
| 7,258,629 | B2 | 8/2007 | Chen | |
| 7,273,423 | B2 | 9/2007 | Imamoto | |
| 7,281,991 | B2 | 10/2007 | Gilbert | |
| 7,351,163 | B2 | 4/2008 | Shimazaki | |
| 7,410,425 | B2 | 8/2008 | Willett | |
| 7,462,110 | B2 | 12/2008 | Yamamoto | |
| 7,494,425 | B2 | 2/2009 | De Shiell et al. | |
| 7,775,904 | B2 | 8/2010 | Hirano | |
| 7,775,907 | B2 | 8/2010 | Hirano | |
| 7,824,280 | B2 | 11/2010 | Yakota | |
| 7,887,432 | B2 | 2/2011 | Jones et al. | |
| 7,887,434 | B2 | 2/2011 | Beach | |
| 7,934,999 | B2 | 5/2011 | Cackett | |
| 7,938,739 | B2 | 5/2011 | Cole et al. | |
| 7,993,217 | B2 | 8/2011 | Cameron | |
| 8,016,694 | B2 | 9/2011 | Llewellyn | |
| 8,262,497 | B2 | 9/2012 | Breier | |
| 8,337,319 | B2 | 12/2012 | Sargent | |
| 8,435,132 | B2 | 5/2013 | Oldknow et al. | |
| 8,579,729 | B2 | 11/2013 | Nelson | |
| 8,684,863 | B2 | 4/2014 | Bezilla | |
| 8,708,838 | B2 | 4/2014 | Ferguson | |
| 8,721,472 | B2 | 5/2014 | Kuan | |
| 8,753,226 | B2 | 6/2014 | Rice | |
| 8,758,163 | B2 | 6/2014 | Stites | |
| 8,894,506 | B1 | 11/2014 | Myers | |
| 8,911,302 | B1 | 12/2014 | Ivanova | |
| 8,915,797 | B1 | 12/2014 | Kuhar | |
| 8,979,671 | B1 | 3/2015 | DeMille | |
| 9,033,813 | B2 | 5/2015 | Oldknow | |
| 9,079,079 | B2 | 7/2015 | Fossum | |
| 9,108,090 | B2 | 8/2015 | Stites | |
| 9,144,722 | B2 | 9/2015 | Schweigert | |
| 9,162,120 | B2 | 10/2015 | Jertson | |
| 9,168,429 | B2 | 10/2015 | Schweigert | |
| 9,186,561 | B2 | 11/2015 | Schweigert | |
| 9,278,264 | B2 | 3/2016 | Stokke | |
| 9,415,280 | B2 | 8/2016 | Stokke | |
| 10,369,430 | B2 * | 8/2019 | Stokke | A63B 60/00 |
| 2006/0240907 | A1 | 10/2006 | Latiri | |
| 2007/0149315 | A1 | 1/2007 | Bennett et al. | |
| 2010/0267467 | A1 | 10/2010 | Stites et al. | |
| 2012/0233838 | A1 | 9/2012 | Swist | |

FOREIGN PATENT DOCUMENTS

| | | |
|---|---|---|
| JP | 2008272274 | 11/2008 |
| JP | 2008272496 | 11/2008 |
| JP | 2010252964 | 11/2010 |
| JP | 2011005166 | 1/2011 |
| JP | 2011005167 | 3/2011 |
| JP | 2011229914 | 11/2011 |

* cited by examiner 100
110
117
121
116
115
111
153
151
120
160
131
130
132
150
152
170
181
182
160
112
140

200
210
117
116
115
111
253
251
220
260
250
252
130
281
282
270
260
240

300
310
117
314
313
130
320
340
353
381
382
351
360
350
352
320
370
360
340

700

1000

GOLF CLUB HEADS WITH SOLE WEIGHTS AND RELATED METHODS

CROSS-REFERENCE TO RELATED APPLICATIONS

This is a continuation U.S. Non-Provisional patent application Ser. No. 15/969,575, filed on May 2, 2018, which is a continuation of U.S. Non-Provisional patent application Ser. No. 15/226,860, filed Aug. 2, 2016, now U.S. Pat. No. 9,987,525, which is a continuation of U.S. Non-Provisional patent application Ser. No. 13/952,425, filed on Jul. 26, 2013, now U.S. Pat. No. 9,415,280, the contents of all which are fully incorporated herein by reference.

TECHNICAL FIELD

This disclosure relates generally to sports equipment, and relates more particularly to golf club heads and related methods.

BACKGROUND

Modern wood-type golf club heads are now almost exclusively made of metal rather than the persimmon wood that gave the clubs their name. These club heads are generally constructed as a hollow metal shell with a relatively thick face to withstand the ball impact, and the club heads typically include a relatively thick sole to withstand grazing impact with the ground and to lower the center of gravity of the club head. Sole weights are typically used in the soles of wood-type club heads to adjust the position of the center of gravity. The positioning of the club head's center of gravity can alter the gear effect produced upon striking a golf ball.

BRIEF DESCRIPTION OF THE DRAWINGS

To facilitate further description of the embodiments, the following drawings are provided in which.

Figure 1:
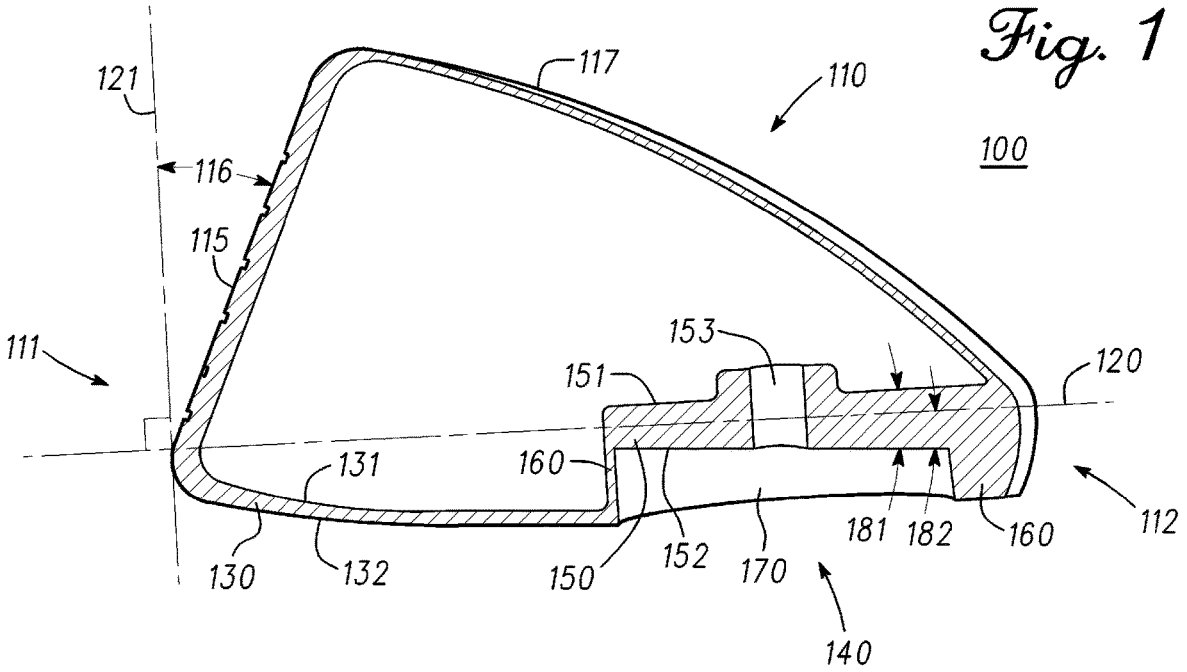
FIG. 1 illustrates a cross-sectional view of an exemplary club head viewed from the side, according to an embodiment.

For simplicity and clarity of illustration, the drawing figures illustrate the general manner of construction, and descriptions and details of well-known features and techniques may be omitted to avoid unnecessarily obscuring the present disclosure. Additionally, elements in the drawing figures are not necessarily drawn to scale. For example, the dimensions of some of the elements in the figures may be exaggerated relative to other elements to help improve understanding of embodiments of the present disclosure. The same reference numerals in different figures denote the same elements.

The terms "first," "second," "third," "fourth," and the like in the description and in the claims, if any, are used for distinguishing between similar elements and not necessarily for describing a particular sequential or chronological order. It is to be understood that the terms so used are interchangeable under appropriate circumstances such that the embodiments described herein are, for example, capable of operation in sequences other than those illustrated or otherwise described herein. Furthermore, the terms "include," and "have," and any variations thereof, are intended to cover a non-exclusive inclusion, such that a process, method, system, article, device, or apparatus that comprises a list of elements is not necessarily limited to those elements, but may include other elements not expressly listed or inherent to such process, method, system, article, device, or apparatus.

The terms "left," "right," "front," "back," "top," "bottom," "over," "under," and the like in the description and in the claims, if any, are used for descriptive purposes and not necessarily for describing permanent relative positions. It is to be understood that the terms so used are interchangeable under appropriate circumstances such that the embodiments of the apparatus, methods, and/or articles of manufacture described herein are, for example, capable of operation in other orientations than those illustrated or otherwise described herein.

The terms "couple," "coupled," "couples," "coupling," and the like should be broadly understood and refer to connecting two or more elements mechanically and/or otherwise. Two or more mechanical elements may be mechanically coupled together, but not be electrically or otherwise coupled together. Coupling may be for any length of time, e.g., permanent or semi-permanent or only for an instant. "Mechanical coupling" and the like should be broadly understood and include mechanical coupling of all types.

The absence of the word "removably," "removable," and the like near the word "coupled," and the like does not mean that the coupling, etc. in question is or is not removable.

As defined herein, two or more elements are "integral" if they are comprised of the same piece of material. As defined herein, two or more elements are "non-integral" if each is comprised of a different piece of material.

As defined herein, "approximately" can, in some embodiments, mean within plus or minus ten percent of the stated value. In other embodiments, "approximately" can mean within plus or minus five percent of the stated value. In further embodiments, "approximately" can mean within plus or minus three percent of the stated value. In yet other embodiments, "approximately" can mean within plus or minus one percent of the stated value.

DESCRIPTION OF EXAMPLES OF EMBODIMENTS

Various embodiments include a golf club head including a sole weight and a body. The body can include a sole including an interior sole surface and an exterior sole surface. The body also can include a sole weight port. The sole weight port can include a port top including an interior port top surface and an exterior port top surface. The exterior port top surface can have a taper of plus or minus approximately 1-30 degrees with respect to a horizontal plane when the golf club head is at an address position. The interior port top surface can have a taper of plus or minus approximately 1-89 degrees with respect to the exterior port top surface. The sole weight port also can include one or more port side walls and a weight-receiving cavity opening to the exterior sole surface and bounded by the exterior port top surface and the one or more port side walls. The sole weight can be conformal with the weight-receiving cavity.

Further embodiments can include a golf club head including a sole weight including a first portion having a first density and a second portion having a second density different than the first density. The first and second portions can be tapered such that a first thickness of the first portion at a first side of the sole weight is greater than a second thickness of the first portion at a second side of the sole weight. The golf club head also can include a body including a sole including an interior sole surface and an exterior sole surface. The body also can include a sole weight port including a port top including an interior port top surface and an exterior port top surface. The sole weight port also can include one or more port side walls and a weight-receiving cavity opening to the exterior sole surface and bounded by the exterior port top surface and the one or more port side walls. The sole weight can have a uniform thickness and can be conformal with the weight-receiving cavity.

Some embodiments include a method. The method can include providing a golf club head including a sole weight and a body. The body can include a sole including an interior sole surface and an exterior sole surface. The body also can include a sole weight port. The sole weight port can include a port top including an interior port top surface and an exterior port top surface. The exterior port top surface can have a taper of plus or minus approximately 1-30 degrees with respect to a horizontal plane when the golf club head is at an address position. The interior port top surface can have a taper of plus or minus approximately 1-89 degrees with respect to the exterior port top surface. The sole weight port also can include one or more port side walls and a weight-receiving cavity opening to the exterior sole surface and bounded by the exterior port top surface and the one or more port side walls. The sole weight can be conformal with the weight-receiving cavity.

Turning to the drawings, FIG. 1 illustrates a cross-sectional view of a golf club head 100 viewed from the side, according to an embodiment. Golf club head 100 is merely exemplary and embodiments of the golf club head are not limited to the embodiments presented herein. The golf club head can be employed in many different embodiments or examples not specifically depicted or described herein.

Figure 5:
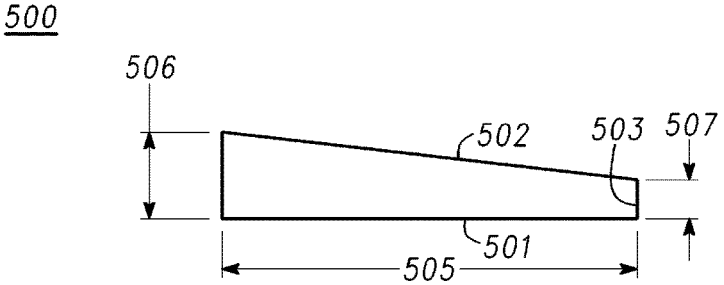
FIG. 5 illustrates a side view of an exemplary sole weight for the club heads of FIGS. 1-4, according to an embodiment.

Golf club head 100 can include a suitable fairway wood-type club head or hybrid-type club head. In a number of embodiments, golf club head 100 can be composed of a body 110, which can be made of stainless steel, titanium, or one or more other materials having a high shear modulus and/or high strength-to-weight ratio. In various embodiments, body 110 can be hollow. In some embodiments, body 110 has a volume of no more than 350 cubic centimeters. In the same or different embodiments, body 110 can have a volume of no more than 250 cubic centimeters. Golf club head 100 can include a sole weight 500, as depicted in FIG. 5, and described below.

When golf club head 100 is at address position, as illustrated in FIG. 1, a horizontal plane 120, and a vertical plane 121 perpendicular to horizontal plane 120, can be defined. Referring to FIG. 1, body 110 can include a front end 111 and a rear end 112. Front end can include a face 115, which can be at a loft angle 116 relative to vertical plane 121. In various embodiments, loft angle 116 of golf club head 100 can be between approximately 14 and 45 degrees. In certain embodiments, loft angle 116 can be between approximately 17 and 31 degrees.

In a number of embodiments, body 110 can include a crown 117 and a sole 130. In some embodiments, crown 117 can extend from the top of face 115 at front end 111 to rear end 112. Sole 130 can extend from the bottom of face 115 at front end 111 to rear end 112. Sole 130 can include an interior sole surface 131 and an exterior sole surface 132. In certain embodiments, body 110 can include a sole weight port 140. In a number of embodiments, sole weight port 140 is integral with sole 130. In other embodiments, sole weight port 140 is non-integral with sole 130. In certain embodiments, sole 130 can surround sole weight port 140. Sole weight port 140 can include a port top 150 and one or more port side walls 160. Port top 150 can include an interior port top surface 151 and an exterior port top surface 152. In some embodiments, port top 150 can include a threaded screw-receiving portion 153. Threaded screw-receiving portion 153 can be configured to receive a screw, and in some embodiments can extend partially or fully across port top 150. In a number of embodiments, threaded screw-receiving portion 153 can protrude into hollow of body 110 beyond interior port top surface 151 so as to provide additional depth for receiving and supporting a screw. Threaded screw-receiving portion 153 can open up into the interior of hollow body 110.

In a number of embodiments, sole weight port 140 can include a weight-receiving cavity 170. Weight-receiving cavity 170 can open to exterior sole surface 132, and can extend between and be bounded by port side walls 160 and exterior port top surface 152. Threaded screw-receiving portion 153 can extend from weight-receiving cavity 170 to the interior of hollow body 110.

Figure 3:
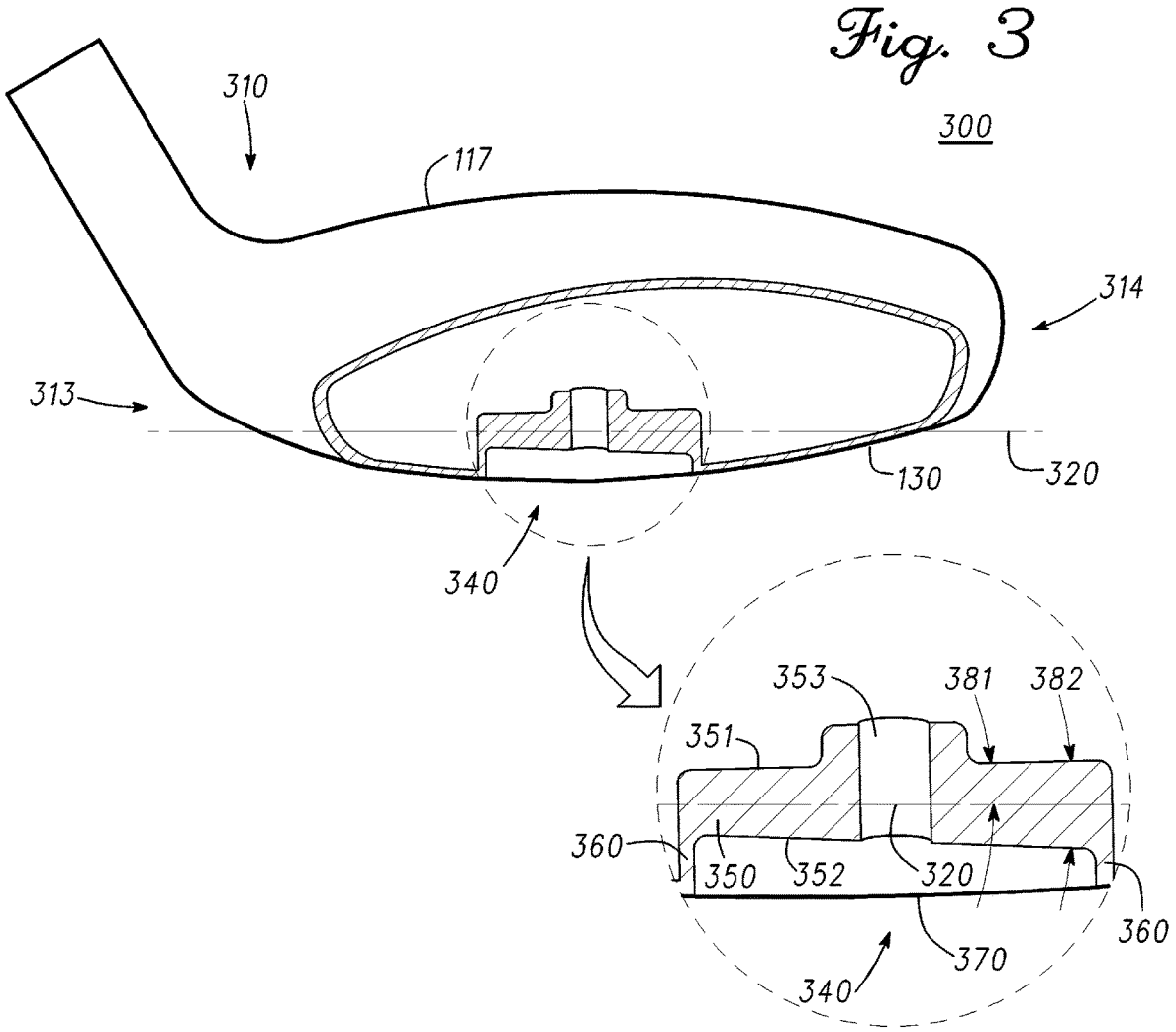
FIG. 3 illustrates a partial cross-sectional view of another exemplary club head viewed from the rear, according to another embodiment.
Figure 4:
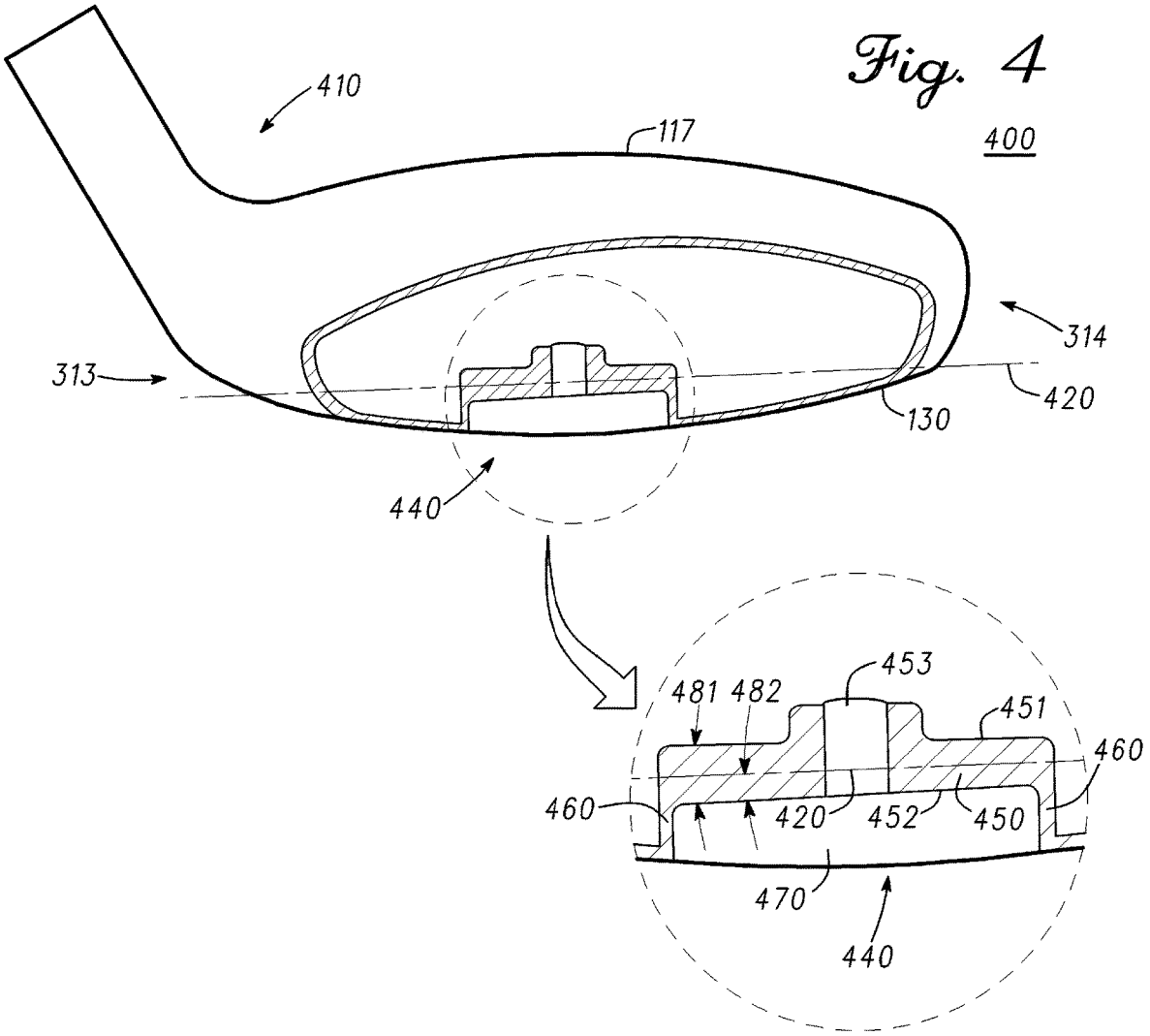
FIG. 4 illustrates a partial cross-sectional view of another exemplary club head viewed from the rear, according to another embodiment.

In some embodiments, sole weight port 140 is located closer to rear end 112 than front end 111. In other embodiments, sole weight port 140 can be located closer to front end 111 than to rear end 112. In yet other embodiments, sole weight port 140 can be located equidistant between front end 111 and rear end 112. In a number of embodiments, sole weight port 140 can be located closer to a heel end 313 (FIG. 3-4) than to a toe end 314 (FIG. 3-4) of golf club head 100, as depicted for golf club head 300 and golf club head 400 in FIGS. 3-4, described below. In other embodiments, sole weight port 140 can be located closer to the toe end 314 (FIG. 3-4) than to the heel end 313 (FIG. 3-4). In yet other embodiments, sole weight port 140 can be located equidistant from the toe end 314 (FIG. 3-4) and the heel end 313 (FIG. 3-4). In certain embodiments, one or more port side walls 160 can extend from weight-receiving cavity 170 to a side of body 110, and can be attached and/or co-formed with the side of body 110. For example, as depicted in FIG. 1, a rear side of one or more port side walls 160 and interior port top surface 151 can extend from sole weight port 140 to a side of body 110 at rear end 112.

In some embodiments, exterior port top surface 152 can have an exterior surface taper 182 with respect to horizontal plane 120. In the embodiment illustrated in FIG. 1, exterior surface taper 182 is approximately minus 10 degrees. In a number of other embodiments, exterior surface taper 182 can be between plus or minus approximately 1 and 30 degrees. In certain specific embodiments, for example, exterior surface taper 182 can be plus or minus approximately 1, 5, 10, 15, 20, 25, or 30 degrees relative to horizontal plane 120. In various embodiments, interior port top surface 151 can have an interior surface taper 181 with respect to exterior port top surface 152. In the embodiment illustrated in FIG. 1, interior surface taper 181 is approximately 12 degrees. In some embodiments, interior surface taper 181 can be between plus or minus approximately 1 and 89 degrees. In a number of embodiments, interior surface taper 181 can be between plus or minus 1 and 60 degrees. In certain specific embodiments, for example, interior surface taper 181 can be plus or minus approximately 1, 5, 10, 15, 20, 25, 30, 35, 40, 45, 50, 55, or 60 degrees. In a number of embodiments, interior port top surface 151 and/or exterior port top surface 152 are substantially planar from one side to an opposite side of sole weight port 140. In other embodiments, one or both of interior port top surface 151 and/or exterior port top surface 152 have a step slope, a curved slope, or another pre-defined slope. In such embodiments, interior port top surface 151 and exterior port top surface 152 can nonetheless have an overall slope or a taper from one side of sole weight port 140 to the opposite side of sole weight port 140.

Figure 2:
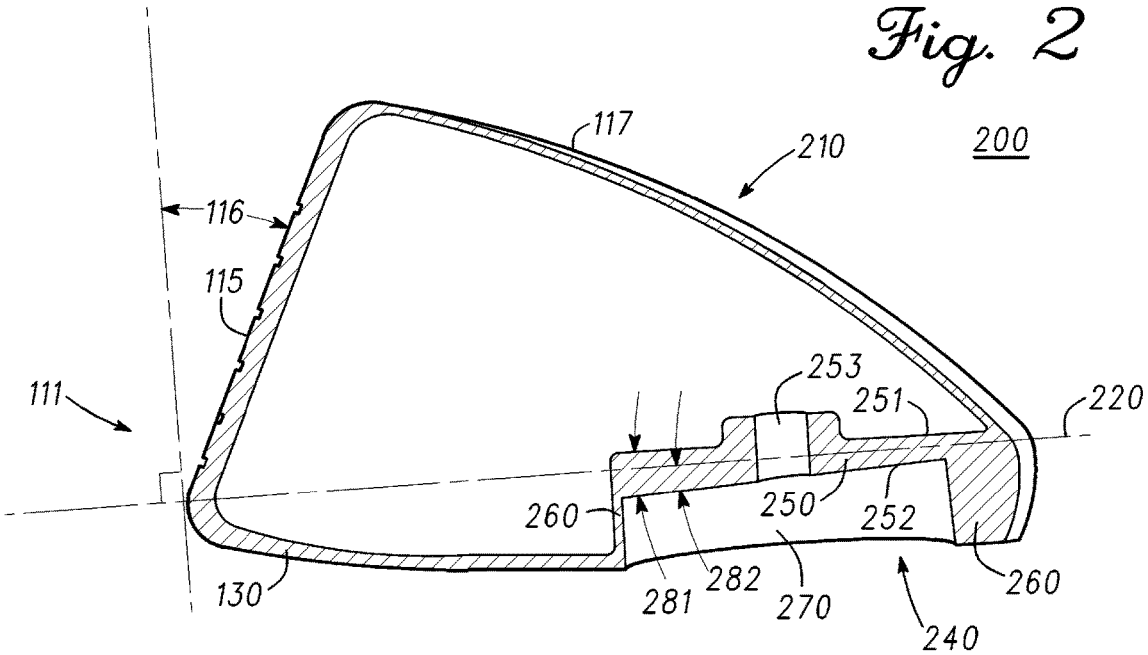
FIG. 2 illustrates a cross-sectional view of another exemplary club head viewed from the side, according to another embodiment.

Turning ahead in the drawings, FIG. 2 illustrates a cross-sectional view of a golf club head 200 viewed from the side. Golf club head 200 can be similar to golf club head 100 (FIG. 1), and various components and/or constructions of golf club head 200 can be substantially identical to various components of golf club head 100. Golf club head 200 can be composed of a body 210, which can be similar to body 110 (FIG. 1). Body 210 can include crown 117, sole 130, and face 115 having a loft angle 116 relative to vertical plane 121. Golf club head 200 also can include sole weight 500, as depicted in FIG. 5, and described below. At address position, as illustrated in FIG. 2, a horizontal plane 220 can be defined. In certain embodiments, body 210 can include a sole weight port 240, which can be similar to sole weight port 140 (FIG. 1). Sole weight port 240 can include a port top 250 and one or more port side walls 260. Port top 250 can include an interior port top surface 251 and an exterior port top surface 252. In some embodiments, port top 250 can include a threaded screw-receiving portion 253. Sole weight port 240 can include a weight-receiving cavity 270. Port top 250 can be similar to port top 150 (FIG. 1); port side walls 260 can be similar to port side walls 160 (FIG. 1); interior port top surface 251 can be similar to interior port top surface 151 (FIG. 1); exterior port top surface 252 can be similar to exterior port top surface 152 (FIG. 1); threaded screw-receiving portion 253 can be similar to threaded screw-receiving portion 153 (FIG. 1); and weight-receiving cavity 270 can be similar to weight-receiving cavity 170 (FIG. 1).

Exterior port top surface 252 can have an exterior surface taper 282 with respect to horizontal plane 220. Interior port top surface 251 can have an interior surface taper 281 with respect to exterior port top surface 252. Various embodiments of exterior surface taper 282 and interior surface taper 281 can be similar to exterior surface taper 182 (FIG. 1) and interior surface taper 181 (FIG. 1), respectively. In the embodiment illustrated in FIG. 2, exterior surface taper 282 is approximately 15 degrees, and interior surface taper 281 is approximately minus 5 degrees.

FIG. 3 illustrates a partial cross-sectional view of a golf club head 300 viewed from the rear. Golf club head 300 can be similar to golf club head 100 (FIG. 1) and/or golf club head 200 (FIG. 2), and various components and/or constructions of golf club head 300 can be substantially identical to various components of golf club head 100 and/or golf club head 200. Golf club head 300 can be composed of a body 310, which can be similar to body 110 (FIG. 1) and/or body 210 (FIG. 2). Body 310 can include crown 117, sole 130, a heel end 313, and a toe end 314. Golf club head 300 also can include sole weight 500, as depicted in FIG. 5, and described below. At address position, as illustrated in FIG. 3, a horizontal plane 320 can be defined. In certain embodiments, body 310 can include a sole weight port 340, which can be similar to sole weight port 140 (FIG. 1) and/or sole weight port 240 (FIG. 2). Sole weight port 340 can include a port top 350 and one or more port side walls 360. Port top 350 can include an interior port top surface 351 and an exterior port top surface 352. In some embodiments, port top 350 can include a threaded screw-receiving portion 353. Sole weight port 340 can include a weight-receiving cavity 370. Port top 350 can be similar to port top 150 (FIG. 1) and/or port top 250 (FIG. 2); port side walls 360 can be similar to port side walls 160 (FIG. 1) and/or port side walls 260 (FIG. 2); interior port top surface 351 can be similar to interior port top surface 151 (FIG. 1) and/or interior port top surface 251 (FIG. 2); exterior port top surface 352 can be similar to exterior port top surface 152 (FIG. 1) and/or exterior port top surface 252 (FIG. 2); threaded screw-receiving portion 353 can be similar to threaded screw-receiving portion 153 (FIG. 1) and/or threaded screw-receiving portion 253 (FIG. 2); and weight-receiving cavity 370 can be similar to weight-receiving cavity 170 (FIG. 1) and/or weight-receiving cavity 270 (FIG. 2).

Exterior port top surface 352 can have an exterior surface taper 382 with respect to horizontal plane 320. Interior port top surface 351 can have an interior surface taper 381 with respect to exterior port top surface 352. In various embodiments exterior surface taper 382 can be similar to exterior surface taper 182 (FIG. 1) and/or exterior surface taper 282 (FIG. 2). In various embodiments, interior surface taper 381 can be similar to interior surface taper 181 (FIG. 1) and/or interior surface taper 281 (FIG. 2). In the embodiment illustrated in FIG. 3, exterior surface taper 382 is approximately minus 15 degrees, and interior surface taper 381 is approximately 12 degrees.

FIG. 4 illustrates a partial cross-sectional view of a golf club head 400 viewed from the rear. Golf club head 400 can be similar to golf club head 100 (FIG. 1), golf club head 200 (FIG. 2) and/or golf club head 300 (FIG. 3), and various components and/or constructions of golf club head 400 can be substantially identical to various components of golf club head 100, golf club head 200, and/or golf club head 300. Golf club head 400 can be composed of a body 410, which can be similar to body 110 (FIG. 1), body 210 (FIG. 2), and/or body 310 (FIG. 3). Body 410 can include crown 117, sole 130, heel end 313, and toe end 314. Golf club head 400 also can include sole weight 500, as depicted in FIG. 5, and described below. At address position, as illustrated in FIG. 4, a horizontal plane 420 can be defined. In certain embodiments, body 410 can include a sole weight port 440, which can be similar to sole weight port 140 (FIG. 1), sole weight port 240 (FIG. 2), and/or sole weight port 340 (FIG. 3). Sole weight port 440 can include a port top 450 and one or more port side walls 460. Port top 450 can include an interior port top surface 451 and an exterior port top surface 452. In some embodiments, port top 450 can include a threaded screw-receiving portion 453. Sole weight port 440 can include a weight-receiving cavity 470. Port top 450 can be similar to port top 150 (FIG. 1), port top 250 (FIG. 2), and/or port top 350 (FIG. 3); port side walls 460 can be similar to port side walls 160 (FIG. 1), port side walls 260 (FIG. 2), and/or port side walls 360 (FIG. 3); interior port top surface 451 can be similar to interior port top surface 151 (FIG. 1), interior port top surface 251 (FIG. 2), and/or interior port top surface 351 (FIG. 3); exterior port top surface 452 can be similar to exterior port top surface 152 (FIG. 1), exterior port top surface 252 (FIG. 2), and/or exterior port top surface 352 (FIG. 3); threaded screw-receiving portion 453 can be similar to threaded screw-receiving portion 153 (FIG. 1), threaded screw-receiving portion 253 (FIG. 2), and/or threaded screw-receiving portion 353 (FIG. 3); and weight-receiving cavity 470 can be similar to weight-receiving cavity 170 (FIG. 1), weight-receiving cavity 270 (FIG. 2), and/or weight-receiving cavity 370 (FIG. 3).

Exterior port top surface 452 can have an exterior surface taper 482 with respect to horizontal plane 420. Interior port top surface 451 can have an interior surface taper 481 with respect to exterior port top surface 452. In various embodiments exterior surface taper 482 can be similar to exterior surface taper 182 (FIG. 1), exterior surface taper 282 (FIG. 2), and/or exterior surface taper 382 (FIG. 3). In various embodiments, interior surface taper 481 can be similar to interior surface taper 181 (FIG. 1), interior surface taper 281 (FIG. 2), and/or interior surface taper 381 (FIG. 3). In the embodiment illustrated in FIG. 4, exterior surface taper 482 is approximately 7 degrees, and interior surface taper 481 is approximately minus 8 degrees.

FIG. 5 illustrates a side view of a sole weight 500. Sole weight 500 can include a sole weight bottom 501, a sole weight top 502, and one or more sole weight sides 503. Sole weight 500 can have a width 505, a maximum thickness 506, and a minimum thickness 507, such that maximum thickness 506 is greater than minimum thickness 507. Width 505 can be greater than maximum thickness 506. In many embodiments, sole weight bottom 501 can have a circular cross section. In other embodiments, sole weight bottom 501 can have another pre-determined cross section, such as an ellipse or a polygon (e.g. triangle, square, rectangle, pentagon, hexagon, etc.). In a number of embodiments, sole weight sides 503 are orthogonal to sole weight bottom 501. Sole weight 500 can be conformal with weight-receiving cavity 170 (FIG. 1), weight-receiving cavity 270 (FIG. 2), weight-receiving cavity 370 (FIG. 3), and/or weight-receiving cavity 470 (FIG. 4). Sole weight top 502 can be tapered with respect to sole weight bottom 501, such than maximum thickness 506 is greater than minimum thickness 507, and in accordance with the exterior surface taper (e.g., 182, 282, 382, 482). In many embodiments, sole weight 500 can have a tapered cylindrical shape. The surface slope of sole weight top 502 can conform to the slope of the exterior port top surface (e.g., 152, 252, 352, 452), such as a planar slope, a step slope, a curved slope, or other suitable slope. In certain embodiments, sole weight bottom 501 can be slightly convex, so as to match a curvature of the surrounding exterior sole surface 132 of sole 130.

Sole weight 500 can be placed inside the weight-receiving cavity (e.g., 170 (FIG. 1), 270 (FIG. 2), 370 (FIG. 3), 470 (FIG. 4)) and can be attached and/or secured to the sole weight port (e.g., 140 (FIG. 1), 240 (FIG. 2), 340 (FIG. 3), 440 (FIG. 4)) with a screw placed through the thickness of sole weight 500 and threaded in the threaded screw-receiving portion (e.g., 153 (FIG. 1), 253 (FIG. 2), 353 (FIG. 3), 453 (FIG. 4)). In the same or other embodiments, sole weight 500 can be secured to the sole weight port (e.g., 140, 240, 340, 440) using an adhesive, such as epoxy. In addition, in many embodiments, the taper of sole weight top 502 can help prevent sole weight 500 from rotating within the weight-receiving cavity (e.g., 170, 270, 370, 470). In addition, in certain embodiments in which sole bottom 501 has a non-circular cross section (e.g., an elliptical or polygonal shape), the geometry of sole weight 500 can lock sole weight 500 in place in the weight-receiving cavity (e.g., 140, 240, 340, 440) against the port side walls (e.g., 160 (FIG. 1), 260 (FIG. 2), 360 (FIG. 3), 460 (FIG. 4)) to prevent rotation of sole weight 500. In certain embodiments in which sole bottom 501 has a circular cross section, sole weight 500 can include gearing teeth that can engage with grooves in the port side walls (e.g., 160, 260, 360, 460) to further prevent rotation of sole weight 500 within the weight-receiving cavity (e.g., 170, 270, 370, 470). In certain embodiments, the tapered geometry of sole weight 500 can form a self-aligned fitting system, such that sole weight 500 can advantageously be placed within the weight-receiving cavity (e.g., 170, 270, 370, 470) only in one orientation.

In a number of embodiments, sole weight 500 can remain uncovered within the sole weight port (e.g., 140, 240, 340, 440). For example, sole weight 500 can have an appliqué on sole weight bottom 501, such as an aluminum stamped set or polycarbonate, or can be exposed. In such embodiments, sole weight 500 is not covered with a sole cap or other sole element over sole weight bottom 501.

Sole weight 500 can have a different density than body 110 (FIG. 1), body 210 (FIG. 2), body 310 (FIG. 3), and/or body 410 (FIG. 4). In many embodiments, sole weight 500 can have a lower density than the sole weight port (e.g., 140, 240, 340, 440). In other embodiments, sole weight 500 can have a higher density than the sole weight port (e.g., 140, 240, 340, 440). Sole weight 500 can be made of a thermoplastic elastomer (TPE) (e.g., thermoplastic polyurethane (TPU)), a suitable metal (e.g., aluminum, steel, titanium, or other suitable metal), or a TPE with metal additives (e.g., TPU with steel and/or tungsten additives). Using metal additives can have the advantage of providing a precise custom density for sole weight 500. Various embodiments of sole weight 500 can have various different densities.

The tapering of the interior surface taper (e.g., 181, 281, 381, 481), the exterior surface taper (e.g., 182, 282, 382, 482), and sole weight top 502 can create certain geometries of the sole weight port (e.g., 140, 240, 340, 440) and sole weight 500. These geometries, along with the relative densities of the sole weight 500 and the sole weight port (e.g., 140, 240, 340, 440) can affect the center of gravity of the golf club head (e.g., 100, 200, 300, 400). Using different geometries and/or densities for one or both of sole weight 500 and/or the sole weight port (e.g., 140, 240, 340, 440) can be used to precisely alter the position of the center of gravity. Different positions of the club head's center of gravity can alter the gear effect produced upon striking the ball. For example, altering the position of the center of gravity to be further rearward can increase the back spin and/or launch produced upon striking the ball. Such changes in the center of gravity position may be desirable, for example, for golf clubs with a low loft angle. Altering the position of the center of gravity to be further forward can decrease the back spin and/or launch produced upon striking the ball. Such changes in the center of gravity position may be desirable, for example, for golf clubs with a high loft angle. Furthermore, altering the position of the center of gravity to be further toward the heel or the toe can alter the component of side spin produced upon striking the ball. Such changes in the center of gravity position may be desirable, for example, for golfers desiring a fade- or draw-biased club.

In certain embodiments, as described above, the density of sole weight 500 can be less than the density of the sole weight port (e.g., 140, 240, 340, 440). For example, in embodiments, such as golf club head 100 depicted in FIG. 1, described above, in which the geometry of sole weight port 140 is such that the thickness of port top 150 is thicker toward rear end 112 than front end 111, and in which maximum thickness 506 of sole weight 500 is closer to front end 111 than minimum thickness 507, the center of gravity of golf club head 100 can positioned further toward the rear. Exterior surface taper 182 and interior surface taper 181 can also affect the vertical positioning of the center of gravity. In other embodiments, the density of sole weight 500 can be higher than the density of sole weight port 140, and the center of gravity of golf club head 100 can be positioned further toward the front.

As a further example, in embodiments such as golf club head 200 depicted in FIG. 2, described above, in which the geometry of sole weight port 240 is such that the thickness of port top 250 is thicker towards front end 111 than rear end 112, in which the density of sole weight 500 is less than the density of sole weight port 140, and in which maximum thickness 506 of sole weight 500 is closer to rear end 112 than minimum thickness 507, the center of gravity of golf club head 200 can positioned further toward the front. In other embodiments, the density of sole weight 500 can be higher than the density of sole weight port 140, and the center of gravity of golf club head 200 can be positioned further toward the rear. In other embodiments, port top 250 can be thicker towards rear end 112 than front end 111, and the maximum thickness of sole weight 500 also can be closer to rear end 112 than front end 111, such as when both the tapers are positive when viewed front to rear. In such cases, for example, the center of gravity can be positioned not only toward the rear, but also higher vertically in golf club head 200.

As still another example, in certain embodiments such as golf club head 300 depicted in FIG. 3, described above, in which the geometry of sole weight port 340 is such that the thickness of port top 350 is thicker towards toe end 314 than heel end 313, in which the density of sole weight 500 is less than the density of sole weight port 340, and in which maximum thickness 506 of sole weight 500 is closer to heel end 313 than minimum thickness 507, the center of gravity can positioned further toward the toe end. In other embodiments, the density of sole weight 500 can be higher than the density of sole weight port 140, the center of gravity of golf club head 300 can be positioned further toward the heel end.

As yet another example, in embodiments such as golf club head 400 depicted in FIG. 4, described above, in which the geometry of sole weight port 440 is such that the thickness of port top 450 is thicker towards heel end 313 than toe end 314, in which the density of sole weight 500 is less than the density of sole weight port 340, and in which maximum thickness 506 of sole weight 500 is closer to toe end 314 than minimum thickness 507, the center of gravity can positioned further toward the heel end. In other embodiments, the density of sole weight 500 can be higher than the density of sole weight port 140, the center of gravity of golf club head 400 can be positioned further toward the toe end.

In some embodiments, the taper of interior surface taper (e.g., 181, 281, 381, 481) and the exterior surface taper (e.g., 182, 282, 382, 482) need not be only along a front-to-rear direction, as in FIGS. 1-2, or only along a heel-to-toe directions, as in FIGS. 3-4. Rather, the interior surface taper and/or the exterior surface taper can be such that it tapers both in a front-to-rear direction and a heel-to-toe direction. Such tapering can allow golf club designers to position the center of gravity further towards the rear, but also further towards the toe, for example. In such manner, golf club designers can select the interior surface taper (e.g., 181, 281, 381, 481), the exterior surface taper (e.g., 182, 282, 382, 482), and the taper of sole weight top 502 to advantageously more precisely position the center of gravity, which can advantageously provide greater club head optimization. Additionally, additional higher- and/or lower-density material can be positioned in optimal locations for creating precise center of gravity positions. Furthermore, club head designers can provide many sole weights similar to sole weight 500 with various densities, which can allow a user to adjust the center of gravity.

Figure 7:
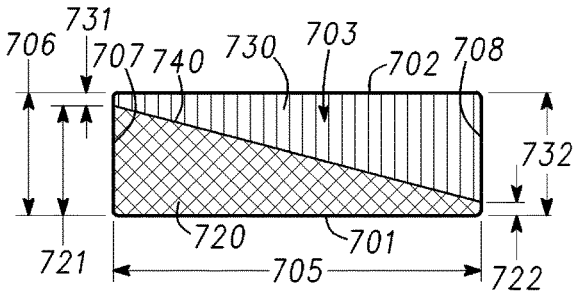
FIG. 7 illustrates a side view of another exemplary sole weight for the club head of FIG. 6, according to the embodiment of FIG. 6.
Figure 8:
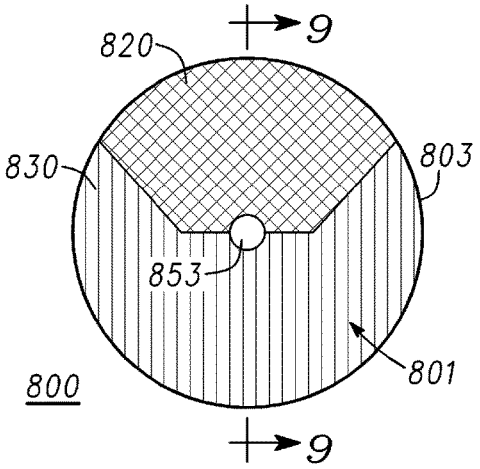
FIG. 8 illustrates a bottom view of another exemplary sole weight for the club head of FIG. 6, according to the embodiment of FIG. 6.
Figure 9:
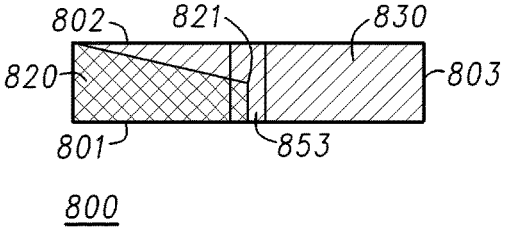
FIG. 9 illustrates a cross-sectional view of the sole weight of FIG. 8.

In certain embodiments, sole weight 500 can include two portions having different densities, similarly as described below for sole weight 700 (FIG. 7) an sole weight 800 (FIGS. 8-9). Sole weight can include a first portion having a first density and a second portion having a second density different from the first density. The first portion and second portion can be tapered such that a first thickness of the first portion at a first side of the sole weight is greater than a second thickness of the first portion at a second side of the sole weight.

Figure 6:
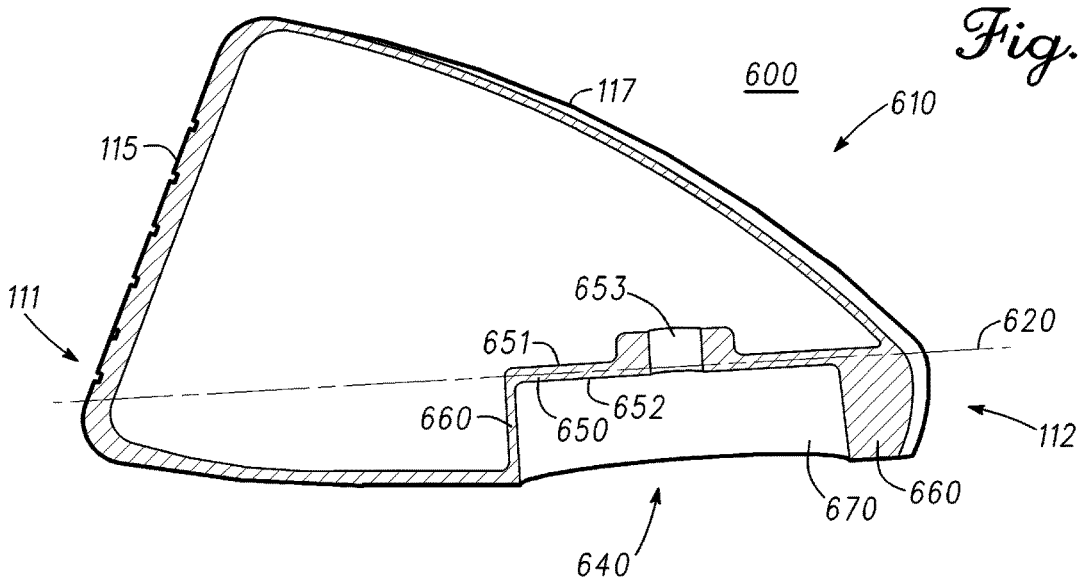
FIG. 6 illustrates a cross-sectional view of another exemplary club head viewed from the side, according to a further embodiment.

FIG. 6 illustrates a cross-sectional view of a golf club head 600 viewed from the side. Golf club head 600 can be similar to golf club head 100 (FIG. 1), golf club head 200 (FIG. 2), golf club head 300 (FIG. 3), and/or golf club head 400 (FIG. 4), and various components and/or constructions of golf club head 600 can be substantially identical to various components of golf club head 100, golf club head 200, golf club head 300, and/or golf club head 400. Golf club head 600 can be composed of a body 610, which can be similar to body 110 (FIG. 1), body 210 (FIG. 2), body 310 (FIG. 3), and/or body 410 (FIG. 4). Body 610 can include crown 117, face 115, sole 130, front end 111, and rear end 112. Golf club head 600 also can include a sole weight, such as sole weight 700, depicted in FIG. 7, described below, or sole weight 800, depicted in FIG. 8, described below. At address position, as illustrated in FIG. 6, a horizontal plane 620 can be defined. In certain embodiments, body 610 can include a sole weight port 640, which can be similar to sole weight port 140 (FIG. 1), sole weight port 240 (FIG. 2), sole weight port 340 (FIG. 3), and/or sole weight port 440 (FIG. 4). Sole weight port 640 can include a port top 650 and one or more port side walls 660. Port top 650 can include an interior port top surface 651 and an exterior port top surface 652. In some embodiments, port top 650 can include a threaded screw-receiving portion 653. Sole weight port 640 can include a weight-receiving cavity 670. Port top 650 can be similar to port top 150 (FIG. 1), port top 250 (FIG. 2), port top 350 (FIG. 3), and/or port top 450 (FIG. 4); port side walls 660 can be similar to port side walls 160 (FIG. 1), port side walls 260 (FIG. 2), port side walls 360 (FIG. 3), and/or port side walls 460 (FIG. 4); interior port top surface 651 can be similar to interior port top surface 151 (FIG. 1), interior port top surface 251 (FIG. 2), interior port top surface 351 (FIG. 3), and/or interior port top surface 451 (FIG. 4); exterior port top surface 652 can be similar to exterior port top surface 152 (FIG. 1), exterior port top surface 252 (FIG. 2), exterior port top surface 352 (FIG. 3), and/or exterior port top surface 452 (FIG. 4); threaded screw-receiving portion 653 can be similar to threaded screw-receiving portion 153 (FIG. 1), threaded screw-receiving portion 253 (FIG. 2), threaded screw-receiving portion 353 (FIG. 3), and/or threaded screw-receiving portion 453 (FIG. 4); and weight-receiving cavity 670 can be similar to weight-receiving cavity 170 (FIG. 1), weight-receiving cavity 270 (FIG. 2), weight-receiving cavity 370 (FIG. 3), and/or weight-receiving cavity 470 (FIG. 4). In some embodiments, interior port top surface 651 and/or exterior port top surface 652 are substantially parallel to horizontal plane 620. In other embodiments, interior port top surface 651 and/or exterior port top surface 652 can have an slope of between plus or minus approximately 1 and 30 degrees with respect to horizontal plane 620. In various embodiments, weight-receiving cavity 670 has a cylindrical shape.

FIG. 7 illustrates a side view of a sole weight 700. Sole weight 700 can include a sole weight bottom 701, a sole weight top 702, and one or more sole weight sides 703. In many embodiments, sole weight bottom 701 can be substantially parallel to sole weight top 702, and the one or more sole weight sides can be substantially orthogonal with sole weight bottom 701 and/or sole weight top 702. Sole weight bottom 701 also can be curved to match the curvature of the exterior sole surface of sole 130 surrounding weight-received cavity 670. In many embodiments, sole weight bottom 701 and sole weight top 702 can have a circular cross section, and sole weight 700 can have a cylindrical shape. In other embodiments, sole weight bottom 701 and sole weight top 702 can have another pre-determined cross section, such as an ellipse or a polygon (e.g., triangle, rectangle, pentagon, hexagon, etc.). In certain embodiments, sole weight 700 can have a regular polygon cross section (e.g., an equilateral triangle, a square, a regular pentagon, a regular hexagon, etc.).

Sole weight 700 can have a width 705 and a thickness 706. Thickness 706 of sole weight 700 can be a uniform thickness. Width 705 can be greater than thickness 706. Sole weight 700 can have a first portion 720 having a first density and a second portion 730 have a second density different than the first density. In some embodiments, first portion 720 has a density greater than second portion 730. In other embodiments, first portion 720 has a density less than second portion 730. First portion 720 and/or second portion 730 can be made of a TPE (e.g., TPU), a suitable metal (e.g., aluminum, steel, titanium, tungsten, or other suitable metal), a TPE with metal additives (e.g., TPU with steel and/or tungsten additives). Using metal additives can have the advantage of providing a custom density. Various embodiments of first portion 720 and second portion 730 can have various different densities.

In many embodiments, first portion 720 and/or second portion 730 can be relatively tapered, such that a first thickness 721 of first portion 720 is greater at a first side 707 of sole weight 700 than a second thickness 722 at a second side 708 of sole weight 700. Similarly, in a number of embodiments, a first thickness 731 of second portion 730 is less at the first side 707 of sole weight 700 than a second thickness 732 at the second side 708 of sole weight 700. In many embodiments, a tapered interface 740 between first portion 720 and second portion 730 can be planar. In other embodiments, tapered interface 740 can be step slope, a curved slope, or another pre-determined slope.

Sole weight 700 can be conformal with weight-receiving cavity 670 (FIG. 6). Sole weight 700 can be placed inside weight-receiving cavity 670 (FIG. 6) and can be attached and/or secured to sole weight port 640 (FIG. 6) with a screw placed through the thickness of sole weight 700 and threaded in threaded screw-receiving portion 653 (FIG. 6). In the same and/or other embodiments, sole weight 700 can be secured to sole weight port 640 (FIG. 6) using an adhesive, such as epoxy. In a number of embodiments, sole weight 700 can remain uncovered within sole weight port 640 (FIG. 6). For example, sole weight 700 can have an appliqué on sole weight bottom 701, such as an aluminum stamped set or polycarbonate, or can be exposed. In such embodiments, sole weight 700 is not covered with a sole cap or other sole element on sole weight bottom 701.

In certain embodiments in which sole bottom 701 has a circular cross section, sole weight 700 can include gearing teeth which can engage with grooves in port side walls 660 (FIG. 6) to further prevent rotation of sole weight 700 within weight-receiving cavity 670 (FIG. 6). In certain other embodiments in which sole bottom 701 has a circular cross section, port side walls 660 (FIG. 6) can include gearing teeth which can engage with grooves in sole weight 700 to further prevent rotation of sole weight 700 within weight receiving cavity 670 (FIG. 6). In addition to non-rotatable positioning of the sole weight 700 in weight-receiving cavity 670 (FIG. 6), in many embodiments, the gearing teeth can be equally spaced such that sole weight 700 can be positioned in two or more orientations. For example, sole weight 700 can have ten gearing teeth equally spaced along sole weight sides 703 to allow sole weight 700 to be inserted in ten different non-rotatable orientations in weight-receiving cavity 670 (FIG. 6). In certain other embodiments in which sole bottom 701 has a non-circular cross section (e.g., an elliptical or polygonal shape), the geometry of sole weight 700 can lock sole weight 700 in place in weight-receiving cavity 670 (FIG. 6) against the port side walls 660 (FIG. 6) to prevent rotation of sole weight 700 within weight-receiving cavity 670. In various embodiments in which sole weight 700 has a regular polygon cross section, in which each side of sole weight sides 703 along sole weight bottom 701 has the same dimension and all angles between adjacent sides of sole weight sides 703 are the same, sole weight 700 can be inserted in weight-receiving cavity 670 (FIG. 6) in two or more orientations for non-rotatable positioning.

The tapered geometries of first portion 720 and second portion 730 in sole weight 700, along with the relative densities of first portion 720 and second portion 730 can affect the center of gravity of golf club head 600 (FIG. 6). Using different geometries and/or densities for these components of sole weight 700 can be used to precisely alter the position of the center of gravity. Furthermore, inserting sole weight 700 in various different orientations in weight-receiving cavity 670 also can allow for adjustment of the center of gravity. As described above, different positions of the club head's center of gravity can alter the gear effect produced upon striking the ball. As such, inserting sole weight 700 in a certain orientation can produce greater back spin and/or a fade bias, for example. Such tapered geometries thus can allow golf club designers to position the center of gravity further towards the rear, but also further towards the toe, for example. In such manner, golf club designers can select the geometries of first portion 720, second portion 730, and the orientation of sole weight 700 inside weight-receiving cavity 670 (FIG. 6) to advantageously precisely position the center of gravity, which can provide greater club head optimization. Furthermore, club head designers can provide many sole weights similar to sole weight 700 with various densities for first portion 720 and section portion 730, which can allow adjustment of the center of gravity by positioning a certain sole weight in a certain orientation. Such adjustability can be provided by the screw inserted through sole weight 700 and into threaded screw-receiving portion 653 (FIG. 6).

FIG. 8 illustrates a bottom view of a sole weight 800. FIG. 9 illustrates a cross-sectional view of sole weight 800. Sole weight 800 can be similar to sole weight 700 (FIG. 7), and various components and/or constructions of sole weight 800 can be identical to various components of sole weight 700. Sole weight 800 can include a sole weight bottom 801, a sole weight top 802, and one or more sole weight sides 803. Sole weight bottom 801 can be identical or similar to sole weight bottom 701 (FIG. 7), sole weight top 802 can be identical or similar to sole weight top 702 (FIG. 7), and sole weight sides 803 can be identical or similar to sole weight sides 703 (FIG. 7). Sole weight 800 can include a first portion 820, a second portion 830, and a screw hole 853. First portion 820 can extend from one side of sole weight 800 partially across the volume of sole weight 800. In some embodiments, first portion can extend from a side of sole weight 800 to screw hole 853. In certain embodiments, such as depicted in FIG. 9, first portion 820 can be tapered from a side of sole weight 800 to a point 821 in between sole weight bottom 801 and sole weight top 802. Sole weight 800 can be conformal with weight-receiving cavity 670 (FIG. 6). Sole weight 800 can be placed inside the weight-receiving cavity 670 (FIG. 6) and can be attached and/or secured to sole weight port 640 (FIG. 6) with a screw placed through the thickness of sole weight 800 and threaded in threaded screw-receiving portion 653 (FIG. 6). In the same and/or other embodiments, sole weight 800 can be secured to sole weight port 640 (FIG. 6) using an adhesive, such as epoxy, as described above in connection with sole weight 700 (FIG. 7). Embodiments of sole weight 800 can be shaped identical or similarly as described above in connection with sole weight 700 (FIG. 7).

First portion 820 can have a first density different than a second density of second portion 830. In some embodiments, first portion 820 has a density greater than second portion 830. In other embodiments, first portion 820 has a density less than second portion 830. First portion 820 and/or second portion 830 can be made of a TPE (e.g., TPU), a suitable metal (e.g., aluminum, steel, titanium, tungsten, or other suitable metal), a TPE with metal additives (e.g., TPU with steel and/or tungsten additives). Using metal additives can have the advantage of providing a custom density. Various embodiments of first portion 820 and second portion 830 can have various different densities. In certain embodiments, second portion 830 can be made of a plastic, and second portion 820 can be made of a metal, which can advantageously facilitate co-molding of first portion 820 and second portion 830. As described above in connection with sole weight 700 (FIG. 7), the tapered geometries of first portion 820 and second portion 830 in sole weight 800, along with the relative densities of first portion 820 and second portion 830 can be affect the center of gravity of golf club head 600 (FIG. 6). Using different geometries and/or densities for these components of sole weight 800 can be used to precisely alter the position of the center of gravity and allow customization by inserting the screw in screw hole 853 and threaded screw-receiving portion 653 (FIG. 6).

Figure 10:
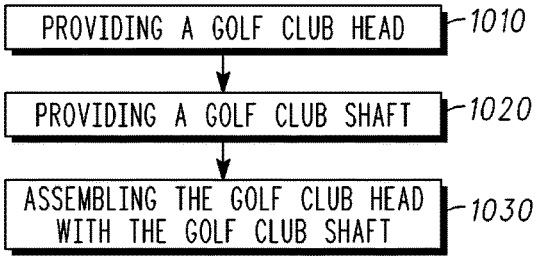
FIG. 10 illustrates a flow chart for an exemplary procedure of providing a golf club head.

Turning ahead in the drawings, FIG. 10 illustrates a flow chart for a method 1000, which can be used to provide, form, and/or manufacture a golf club head and/or a golf club in accordance with the present disclosure. Method 1000 is merely exemplary and is not limited to the embodiments presented herein. Method 1000 can be employed in many different embodiments or examples not specifically depicted or described herein. In some embodiments, the procedures, the processes, and/or the activities of method 1000 can be performed in the order presented. In other embodiments, the procedures, the processes, and/or the activities of method 1000 can be performed in any suitable order. In still other embodiments, one or more of the procedures, the processes, and/or the activities of method 1000 can be combined or skipped.

Referring to FIG. 1000, method 1000 can include block 1010 for providing a golf club head. In many embodiments, the golf club head can be similar or identical to golf club head 100 (FIG. 1), golf club head 200 (FIG. 2), golf club head 300 (FIG. 3), golf club head 400 (FIG. 4), and/or golf club head 600 (FIG. 6). The golf club head of method 1000 can include a body, which can include a sole, a crown, a face, and/or a sole weight port, and which can be identical or similar to body 110 (FIG. 1), body 210 (FIG. 2), body 310 (FIG. 3), body 410 (FIG. 4), and/or body 610 (FIG. 6). The body of method 1000 can be provided via casting, forging, milling, machining, molding, and/or other processes, where the portions of the body can be a single piece or can include several pieces coupled together such as via welding, brazing, and/or adhesives. In one embodiment, the sole weight port can be formed integrally with the sole. In other embodiments, the sole weight port can be formed integrally with the sole and a crown. In any of these embodiments, the face can be manufactured separately and subsequently coupled to the rest of the body. The golf club head of method 1000 can include a sole weight, which can be identical or similar to sole weight 500 (FIG. 5), sole weight 700 (FIG. 7), and/or sole weight 800 (FIGS. 8-9). The sole weight of method 1000 can be provided via casting, forging, milling machining, molding, and/or other processes, where the portions of the sole weight can be a single piece or can include several pieces coupled together such as via welding, brazing, and/or adhesives. The golf club head of method 1000 can further be provided by assembling the sole weight with the body, such as via adhesives, screws, and/or other processes, as described above.

Method 1000 also can include block 1020 for providing a golf club shaft. The golf club shaft of method 1000 can be identical or similar to golf club shaft 1120, depicted in FIG. 11 and described below. The golf club shaft of method 1000 can be provided via casting, forging, milling, machining, molding, and/or other processes.

Method 1000 also can include block 1030 for assembling the golf club head with the golf club shaft. The golf club head and golf club shaft of method 1000 can be assembled through welding, brazing, adhesives, and/or other processes.

Figure 11:
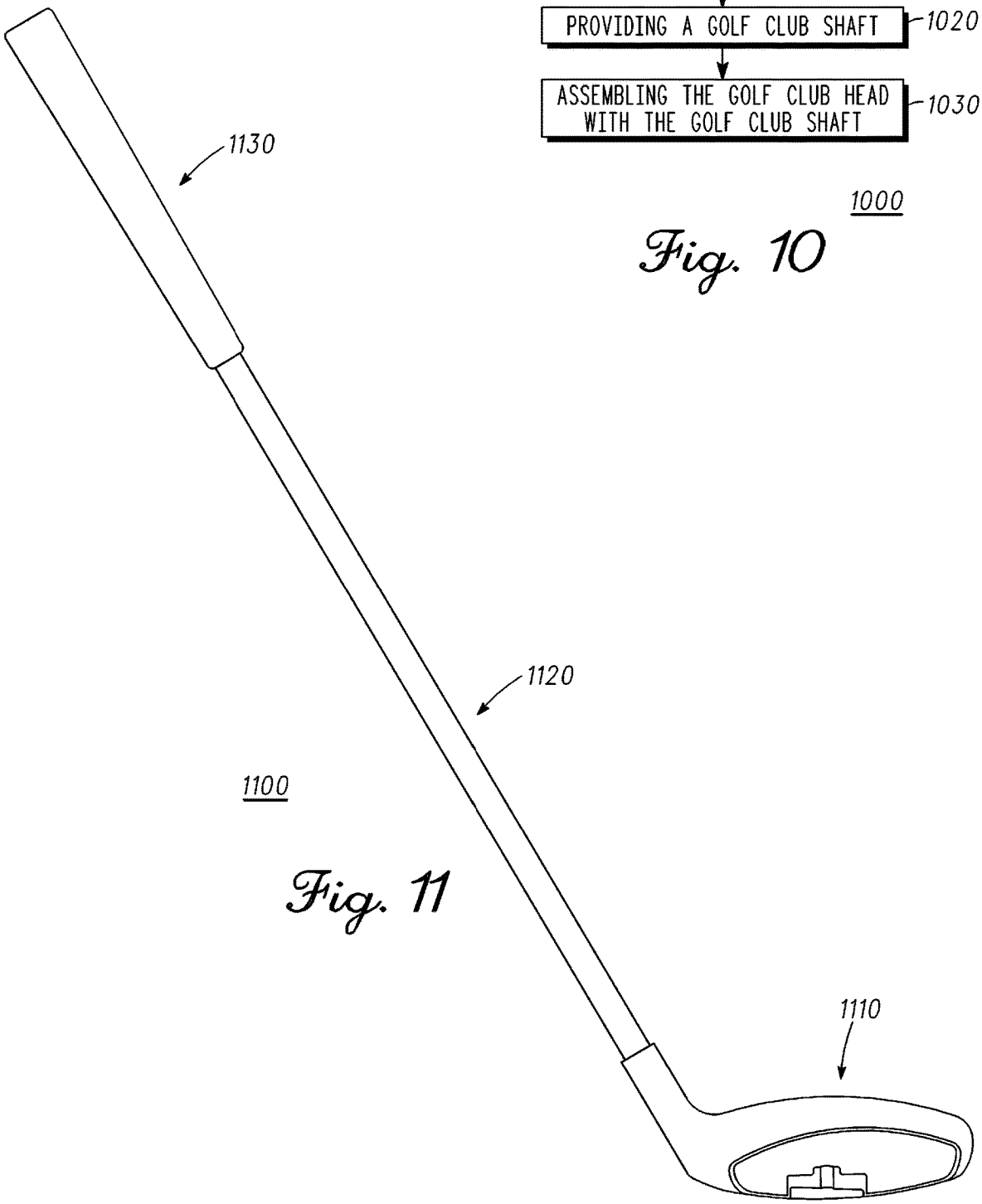
FIG. 11 illustrates a partial cross sectional view of an exemplary golf club viewed from the rear, according to an embodiment.

Returning to the figures, FIG. 11 illustrates a partial cross sectional view of a golf club 1100 viewed from the rear. Golf club 1100 can include golf club head 1110. Golf club head 1110 can be similar or identical to golf club head 100 (FIG. 1), golf club head 200 (FIG. 2), golf club head 300 (FIG. 3), golf club head 400 (FIG. 4), and/or golf club head 600 (FIG. 6), and various components and/or constructions of golf club head 1100 can be identical to various components of golf club head 100, golf club head 200, golf club head 300, golf club head 400, and/or golf club head 600. Golf club 1100 also can include golf club shaft 1120. Golf club shaft can be made of metal, graphite (such as carbon fiber), fiberglass, or another suitable material. In some embodiments, when assembled in golf club 1100, shaft 1120 can have a length less than 44 inches. Golf club 1100 also can include grip 1130. Grip 1130 can provide a comfortable traction for a user in holding and swinging golf club 1100.

Although the club head with tapered sole weight has been described with reference to specific embodiments, it will be understood by those skilled in the art that various changes may be made without departing from the spirit or scope of the present disclosure. For example, to one of ordinary skill in the art, it will be readily apparent that blocks 1010 and blocks 1020 of FIG. 1000 can be comprised of many different procedures, processes, and activities and be performed by many different modules, in many different orders, that various elements of FIGS. 1-11 may be modified, and that the foregoing discussion of certain of these embodiments does not necessarily represent a complete description of all possible embodiments.

As the rules to golf may change from time to time (e.g., new regulations may be adopted or old rules may be eliminated or modified by golf standard organizations and/or governing bodies such as the United States Golf Association (USGA), the Royal and Ancient Golf Club of St. Andrews (R&A), etc.), golf equipment related to the apparatus, methods, and articles of manufacture described herein may be conforming or non-conforming to the rules of golf at any particular time. Accordingly, golf equipment related to the apparatus, methods, and articles of manufacture described herein may be advertised, offered for sale, and/or sold as conforming or non-conforming golf equipment. The apparatus, methods, and articles of manufacture described herein are not limited in this regard.

While the above examples may be described in connection with a fairway wood-type or hybrid-type golf club head, the apparatus, methods, and articles of manufacture described herein may be applicable to other types of golf clubs such as a driver wood-type golf club, an iron-type golf club, a wedge-type golf club, or a putter-type golf club. Alternatively, the apparatus, methods, and articles of manufacture described herein may be applicable other type of sports equipment such as a hockey stick, a tennis racket, a fishing pole, a ski pole, etc.

Additional examples of such changes have been given in the foregoing description. Other permutations of the different embodiments having one or more of the features of the various figures are likewise contemplated. Accordingly, the disclosure of embodiments is intended to be illustrative and is not intended to be limiting. It is intended that the scope of the present disclosure shall be limited only to the extent required by the appended claims.

The club head with tapered sole weight discussed herein may be implemented in a variety of embodiments, and the foregoing discussion of certain of these embodiments does not necessarily represent a complete description of all possible embodiments. Rather, the detailed description of the drawings, and the drawings themselves, disclose at least one preferred embodiments, and may disclose alternative embodiments.

All elements claimed in any particular claim are essential to the embodiment claimed in that particular claim. Consequently, replacement of one or more claimed elements constitutes reconstruction and not repair. Additionally, benefits, other advantages, and solutions to problems have been described with regard to specific embodiments. The benefits, advantages, solutions to problems, and any element or elements that may cause any benefit, advantage, or solution to occur or become more pronounced, however, are not to be construed as critical, required, or essential features or elements of any or all of the claims, unless such benefits, advantages, solutions, or elements are expressly stated in such claim.

Moreover, embodiments and limitations disclosed herein are not dedicated to the public under the doctrine of dedication if the embodiments and/or limitations: (1) are not expressly claimed in the claims; and (2) are or are potentially equivalents of express elements and/or limitations in the claims under the doctrine of equivalents.

What is claimed is:

1. A golf club head comprising:
a sole weight; and
a body comprising:
a sole comprising an exterior sole surface; and
a sole weight port comprising:
a port top comprising an interior port top surface and an exterior port top surface, the interior port top surface having a taper of plus or minus approximately 1-89 degrees with respect to the exterior port top surface;
a weight-receiving cavity that engages the sole weight; wherein,
the sole and the sole weight port are co-molded, such that the sole surrounds the sole weight port;
wherein the sole weight has a lower density than the sole weight port; and
wherein the body is made of one or more materials having a high shear modulus.

2. The golf club head of claim 1, wherein the body comprises a front end and a rear end, and the sole weight port is located closer to the rear end than the front end.

3. The golf club head of claim 1, wherein the port top includes a threaded screw-receiving portion, and the sole weight includes a screw-receiving hole.

4. The golf club head of claim 1, wherein the sole weight comprises a tapered geometry that forms a self-aligned fitting system, which allows the sole weight to be placed in the sole weight port in only one orientation.

5. The golf club head of claim 1, wherein the sole weight comprises a material selected from the group consisting of: a thermoplastic elastomer, aluminum, steel, titanium, tungsten, a suitable metal alloy, and a thermoplastic elastomer with metal additives.

6. The golf club head of claim 1, the sole weight port further comprises:
one or more port side walls; and
a weight-receiving cavity opening to the exterior sole surface and bounded by the exterior port top surface and the one or more port side walls.

7. The golf club head of claim 6, wherein a rear side of the one or more port side walls and the interior port top surface can extend from the sole weight port to a side of the body.

8. The golf club head of claim 1, wherein either one or both of the interior port top surface and the exterior port top surface taper in a front-to-rear direction.

9. The golf club head of claim 1, wherein either one or both of the interior port top surface and the exterior port top surface taper in a heel-to-toe direction.

10. The golf club head of claim 1, wherein either one or both of the interior port top surface and the exterior port top surface taper in both a front-to-rear direction and a heel-to-toe direction.

11. A golf club head comprising:
a sole weight; and
a body comprising:
a sole comprising an exterior sole surface; and
a sole weight port comprising:
a port top comprising an interior port top surface and an exterior port top surface, the interior port top surface having a taper of plus or minus approximately 1-89 degrees with respect to the exterior port top surface;
a weight-receiving cavity that engages the sole weight; wherein,
the sole and the sole weight port are co-molded, such that the sole surrounds the sole weight port;

wherein the sole weight has a higher density than the sole weight port; and wherein the body is made of one or more materials having a high shear modulus.

12. The golf club head of claim 11, wherein the body comprises a front end and a rear end, and the sole weight port is located closer to the rear end than the front end.

13. The golf club head of claim 11, wherein the port top includes a threaded screw-receiving portion, and the sole weight includes a screw-receiving hole.

14. The golf club head of claim 11, wherein the sole weight comprises a tapered geometry that forms a self-aligned fitting system, which allows the sole weight to be placed in the sole weight port in only one orientation.

15. The golf club head of claim 11, wherein the sole weight comprises a material selected from the group consisting of: a thermoplastic elastomer, aluminum, steel, titanium, tungsten, a suitable metal alloy, and a thermoplastic elastomer with metal additives.

16. The golf club head of claim 11, wherein either one or both of the interior port top surface and the exterior port top surface taper in a front-to-rear direction.

17. The golf club head of claim 11, wherein either one or both of the interior port top surface and the exterior port top surface taper in a heel-to-toe direction.

18. The golf club head of claim 11, wherein:

the body has a volume of no more than 350 cubic centimeters; and the body comprises a face having a loft angle of approximately 17-31 degrees relative to a vertical plane perpendicular to a horizontal plane when the golf club head is at an address position.

19. The golf club head of claim 11, wherein:

the sole weight port further comprises:

one or more port side walls; and a weight-receiving cavity opening to the exterior sole surface and bounded by the exterior port top surface and the one or more port side walls.

20. The golf club head of claim 19, wherein a rear side of the one or more port side walls and the interior port top surface can extend from the sole weight port to a side of the body.

* * * * *